United States Patent [19]

Boiko et al.

[11] Patent Number: 4,746,047

[45] Date of Patent: May 24, 1988

[54] HAND-HELD FASTENING ELEMENT DRIVING TOOL

[75] Inventors: Vitaly T. Boiko, Khimki; Boris G. Goldshtein, Moscow; Antanas-Sharunas A. Maljukyavichus, Vilnjus; Marlen A. Shneiderman; Karl K. Dubov, both of Moscow; Arkady A. Buravtsov; Vladimir A. Gordeev, both of Vilnjus; Grigory I. Grechushkin, Moscow, all of U.S.S.R.

[73] Assignee: Moskovskoe Naucho-Rpoizvodstvennoe Objedinenie PO Mekhanizirovannomu Stroitelnomu Instrumentu I Otdelchnym Mashinam, Khimki, U.S.S.R.

[21] Appl. No.: 8,448

[22] Filed: Jan. 28, 1987

[51] Int. Cl.[4] ..... B25C 1/04; B25C 7/00

[52] U.S. Cl. ..... 227/120; 227/130

[58] Field of Search ..... 227/10, 120, 130

[56] References Cited

U.S. PATENT DOCUMENTS

| | | | |
|---|---|---|---|
| 3,991,925 | 11/1976 | Büchel | 227/10 |
| 4,401,251 | 8/1983 | Nikolich | 227/130 |
| 4,441,644 | 4/1984 | Farian | 227/130 |
| 4,492,329 | 1/1985 | Benson et al. | 227/10 |
| 4,493,376 | 1/1985 | Kopf | 227/10 |
| 4,610,381 | 9/1986 | Kramer et al. | 227/120 |

FOREIGN PATENT DOCUMENTS

| | | |
|---|---|---|
| 1170338 | 5/1964 | Fed. Rep. of Germany . |
| 2757698 | 6/1978 | Fed. Rep. of Germany . |

*Primary Examiner*—Paul A. Bell

*Attorney, Agent, or Firm*—McAulay, Fields, Fisher, Goldstein & Nissen

[57] ABSTRACT

A hand-held fastening element driving tool comprising a housing with a handle. A barrel holder with a barrel is free to move axially in the housing. The barrel holder has a extension enclosed in the housing and is provided with a cylindrical shoulder. This shoulder acts, through the agency of an elastic element, upon a corresponding shoulder of the housing. Another elastic element is fitted between the outer side surface of the barrel holder shoulder and the housing. A fastening element magazine has one end thereof connected to the barrel holder, and its other end is loosely articulated to the handle.

14 Claims, 1 Drawing Sheet

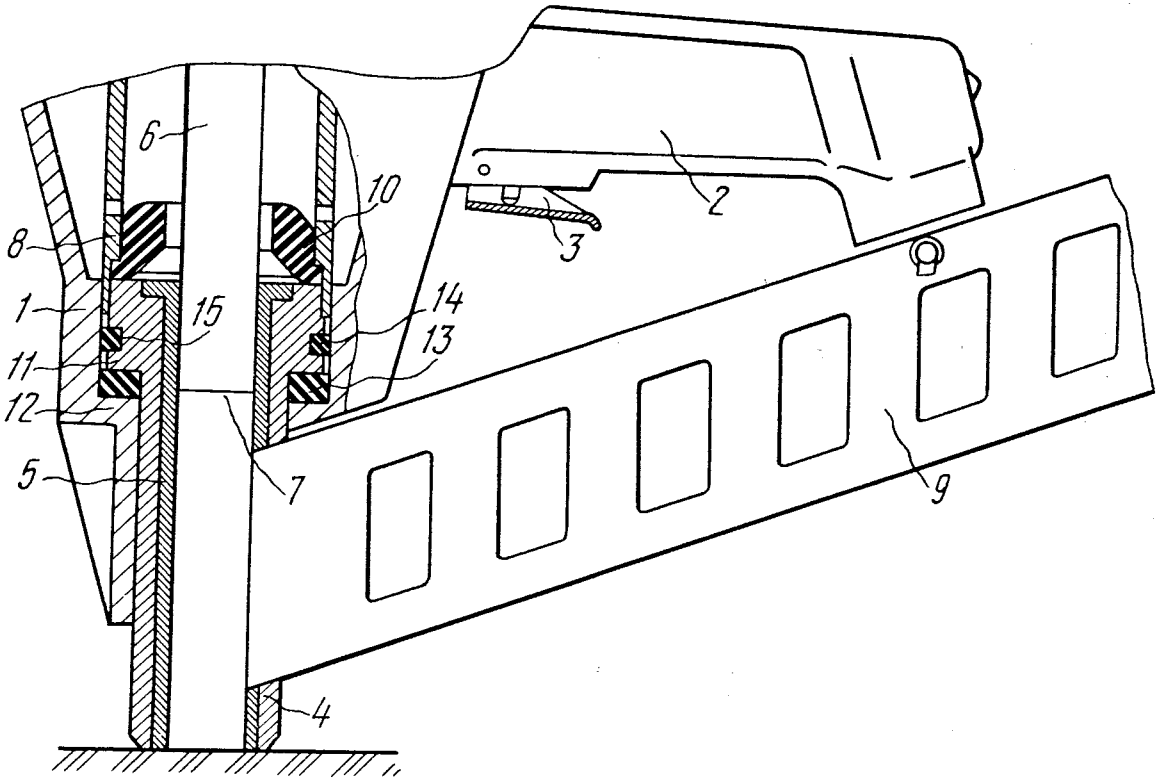
9
2
3
14
13
10
7
4
15
6
8
1
11
12
5

HAND-HELD FASTENING ELEMENT DRIVING TOOL

TECHNICAL FIELD

The herein proposed invention relates generally to the field of mechanical engineering and more specifically, to a hand-held fastening element driving tool.

BACKGROUND OF THE INVENTION

The herein proposed invention is useful for driving nails and staples into wooden structures at integrated house-building factories of the forestry and woodworking industries as well as for manufacturing of wooden panels for containers and packing cases.

In tools of this kind, the housings are conventionally made of aluminium alloys. High labour consumtpion of the casting process and the inadequate strength of the bottom portion of the housing (where it is coupled with the barrel holder) affect much adversely the mass characteristics of these members, since attempts to improve the strength of the load-bearing walls involve greater metal consumption whereby the overall weight of the tool itself is also increased. A trend to reduce the mass of the hand-held tools has led to the replacement of aluminium alloys by plastics.

Not to affect the strength of the bottom portion of the housing, which is the most heavily loaded portion thereof, an optimum solution would be to relieve this portion of the housing from the peak impact forces. As, during impact loading, the action of the peak impact forces is only momentary, the strength of the housing can be substantially improved by extending the time during which an impact load is actually relayed from the barrel to the housing.

Known in the present state of the art is a hand-held fastening element driving tool (cf., laid-open Application No. 2,757,698, Federal Republic of Germany , Int. Cl.$^3$ B25C 1/100) comprising a housing which accommodates an actuator, a barrel incorporating striker, a starting device and a fastening element magazine coupled with the housing.

This tool is highly efficient and provides lasting performance.

However, the residual impulse loads developed in driving the fastening elements, are relayed, via a dashpot, to the lower portion of the housing. Because of this, the housing needs reinforcement so as to provide the requisite strength, which renders it highly labour-consuming in manufacture.

Another hand-held fastening element driving tool (cf., German Pat. No. 1,170,338, Int. Cl. 87a, 18) is known presently to comprise a housing which accommodates an air-operated actuator. A barrel holder is locked in place with the lower portion of the body. The barrel holder incorporates a barrel with a striker. A fastening element magazine is connected to the barrel holder.

This tool is also highly efficient but demands much labour to produce its housing.

Besides, unless the fastening elements are joined in a stack, an element due to be fed in the barrel is likely to get stuck up. In such cases, additional shaking up is oftentimes necessary to push the element right home.

SUMMARY OF THE INVENTION

It is a primary object of this invention to provide a hand-held fastening element driving tool wherein the impulse loads on the housing would be reduced.

It is another object of this invention to provide a hand-held fastening element driving tool wherein the feeding of the fastening elements would be more positive.

The above-said object is accomplished due to the fact that in a hand-held fastening element driving tool comprising a housing provided with a handle, a barrel holder which is enclosed in the housing and incorporates a barrel accommodating a striker connected to an actuator, and a fastening element magazine, whose one end is coupled to the barrel holder, according to the invention, the barrel holder fitted in the housing is free to move axially and has an extension thereof enclosed in the housing and provided with a cylindrical shoulder which acts, through the agency of an elastic element, on a respective shoulder of the housing, another elastic element being fitted between the outer side surface of the cylindrical shoulder, the barrel holder and the housing, whereas the other end of the magazine is loosely articulated to the handle.

As a result, the impulse loads on the housing are substantially reduced by the counteraction of the static moment of the movable barrel holder associated with the fastening element magazine.

This opens the way for the manufacture of the main portion of the housing from less strong materials (such as plastics), which considerably simplifies the manufacture of the entire tool.

Besides, the impacts impart momentary jerks to the barrel holder whereby the fastening element magazine is shaken up and the fastening element to be immediately driven is positively fed to the barrel.

BRIEF DESCRIPTION OF THE DRAWINGS

In what follows the present invention will now be disclosed in a detailed description of an illustrative embodiment thereof with reference to the accompanying drawing, which is a longitudinal section of a hand-held fastening element driving tool, according to the invention.

DETAILED DESCRIPTION OF THE INVENTION

A hand-held fastening element driving tool comprises a housing 1 (FIG. 1) provided with a handle 2 which accommodates a starting device 3. A barrel holder 4 is enclosed in the housing 1 and incorporates a barrel 5. Fitted in the barrel is a striker 6 having an impact end face 7 thereof and connected to an air-operated actuator 8. A fastening element magazine 9 has one end thereof coupled to the barrel holder 4, while its other end is loosely articulated to the handle 2 of the housing 1. The air-operated actuator 8 incorporates a working stroke limiter 10 of the striker 6, the former resting against the barrel holder 4. The barrel holder 4 fitted in the housing 1 is free to move axially. The barrel holder 4 is provided with a cylindrical shoulder 11 which acts, through the agency of an elastic element 13. Another elastic element 14 fitted in a groove 15 on the side surface of the cylindrical shoulder 11 of the barrel holder 4 is provided between the outer side surface of the cylindrical shoulder 11 of the barrel holder 4 and the housing 1.

The hand-held fastening element driving tool operates as follows.

Upon pressing the starting device 3, the striker 6, which serves as the stem of the air-operated actuator 8, is thrust downwards, on its working stroke, until it is stopped by the limiter 10, whereby a fastening element fed into the barrel 5 from the magazine 9 is driven outwards. In doing so, the impact end fact 7 of the striker 6 hits the part in which the fastening element has been driven. Upon reaching the working stroke limiter 10, the piston is stopped so that the residual impact energy (that part which still remains after the blow) is transferred to the limiter.

The residual impact energy is relayed, via the working stroke limiter 10, to the barrel holder 4, which rests against the material being handled and is rigidly coupled with one end of the magazine 9, the other end of said magazine being loosely articulated to the handle 2 of the housing 1.

As the fastening element is being inserted, the unused part of the force developed by the striker 6 is relayed by the limiter 10 to the barrel holder 4, which is moved axially to act upon the elastic elements 13 and 14, the latter absorbing the impact load on the housing 1. Consequently, the housing 1 receives only a small part of the impact energy, which enables the main portion of the housing to be made from less strong materials.

Since the end of the magazine 9 is locked-in with the barrel holder 4, it moves along with the latter to shake up a stack of fastening elements in the magazine 9 ensuring its positive feed to the barrel 5, which contributes to uninterrupted operation of the tool.

The present invention provides a substantial reduction in the impulse loads on the housing.

As a result, the main portion of the housing may be manufactured from less strong materials (such as plastics), which considerably simplifies the manufacture of the entire tool.

Besides, the impacts impart momentary jerks to the barrel holder whereby the fastening element magazine is shaken up and the fastening element to be immediately driven is positively fed to the barrel.

We claim:

1. A hand-held fastener driving tool comprising:

a housing;

a handle secured to said housing;

a cylindrical bore in said housing;

a barrel holder mounted in said bore and having one end thereof enclosed in said housing;

said barrel holder being axially movable in said bore;

a barrel coupled to said barrel holder;

a striker mounted for reciprocatory movement in said barrel;

an actuator accommodated in said housing and connected to said striker to impart reciprocatory movement thereto;

a housing shoulder provided on the inner surface of said cylindrical bore;

a barrel holder shoulder provided at the end of said barrel holder mounted in said bore of said housing;

a first elastic member provided between said housing shoulder and said cylindrical barrel holder shoulder, said housing shoulder acting upon said barrel holder through the agency of said first elastic member;

a second elastic member provided between the outer peripheral surface of said barrel holder shoulder and the inner surface of said cylindrical bore, said second elastic member being mounted in a groove provided in the outer surface of said barrel holder; and a magazine for fasteners having one end thereof rigidly secured to said barrel holder for feeding said fasteners to said barrel and the other end thereof pivotally connected to said handle for rotation in a plane drawn through the axis of said barrel.

2. The driving tool of claim 1, wherein said barrel holder shoulder is cylindrical.

3. The driving tool of claim 1, wherein said first elastic member is fitted between said shoulders.

4. The driving tool of claim 1, wherein said second elastic member is fitted between the outer peripheral surface of said barrel holder and the inner surface of said cylindrical bore, and being fitted in said groove.

5. The driving tool of claim 1, wherein said barrel holder has an extension enclosed in said housing, said barrel holder shoulder being mounted in said extension.

6. The driving tool of claim 5, wherein the main portion of said housing is made from plastic material.

7. The driving tool of claim 5, wherein said striker has an impact end face and is connected to an air-operated actuator.

8. The driving tool of claim 5, wherein said barrel holder shoulder is cylindrical.

9. The driving tool of claim 8, wherein said first elastic member is fitted between said shoulders.

10. The driving tool of claim 9, wherein said second elastic member is fitted between the outer peripheral surface of said barrel holder and the inner surface of said cylindrical bore, and being fitted in said groove.

11. The driving tool of claim 10, wherein the main portion of said housing is made from plastic material.

12. The driving tool of claim 10, wherein said striker has an impact end face and is connected to an air-operated actuator.

13. The driving tool of claim 1, wherein the main portion of said housing is made from plastic material.

14. The driving tool of claim 1, wherein said striker has an impact end face and is connected to an air-operated actuator.

* * * * *